US008191469B2

(12) United States Patent
Bergman et al.

(10) Patent No.: US 8,191,469 B2
(45) Date of Patent: Jun. 5, 2012

(54) DEVICE AND METHOD FOR EVACUATING A STORAGE BAG

(75) Inventors: Carl L. Bergman, Loveland, OH (US); Chinto Benjamin Gaw, Cincinnati, OH (US)

(73) Assignee: The Glad Products Company, Oakland, CA (US)

( * ) Notice: Subject to any disclaimer, the term of this patent is extended or adjusted under 35 U.S.C. 154(b) by 1044 days.

(21) Appl. No.: 11/913,055

(22) Filed: May 19, 2008

(65) Prior Publication Data

US 2009/0007803 A1 Jan. 8, 2009

Related U.S. Application Data

(63) Continuation of application No. PCT/US2006/019818, filed on May 22, 2006.

(60) Provisional application No. 60/685,462, filed on May 27, 2005.

(51) Int. Cl.
*B65B 31/04* (2006.01)
*B65B 31/06* (2006.01)

(52) U.S. Cl. ..... 99/472; 206/524.8

(58) Field of Classification Search ..... 99/472; 206/524.8; 383/100–103, 68; 141/65; 53/405, 53/403

See application file for complete search history.

(56) References Cited

U.S. PATENT DOCUMENTS 2,648,474 A 10/1953 Crook
2,672,268 A * 3/1954 Bower ..... 206/524.8
2,695,741 A 11/1954 Haley
3,958,693 A * 5/1976 Greene ..... 206/455
4,114,668 A * 9/1978 Hickey ..... 220/232
4,249,583 A 2/1981 Lundbladh
4,278,114 A 7/1981 Ruberg
4,287,819 A 9/1981 Emerit
4,290,253 A 9/1981 Domke et al.
4,583,925 A 4/1986 Hawkins
4,615,361 A 10/1986 Bartle
4,745,730 A 5/1988 Bartle
4,756,422 A * 7/1988 Kristen ..... 206/524.8
4,928,829 A * 5/1990 Di Bernardo ..... 206/524.8
4,975,028 A 12/1990 Schultz
5,048,269 A * 9/1991 Deni ..... 53/512
5,121,590 A 6/1992 Scanlan
5,195,427 A 3/1993 Germano
5,215,445 A 6/1993 Chen et al.
D338,399 S * 8/1993 Conte, Jr. ..... D9/709
5,299,917 A 4/1994 Schultz
5,338,166 A 8/1994 Schultz
RE34,929 E * 5/1995 Kristen ..... 206/524.8
5,480,030 A * 1/1996 Sweeney et al. ..... 206/524.8
5,501,525 A * 3/1996 Cox et al. ..... 383/103
(Continued)

*Primary Examiner* — Mitra Aryanpour
(74) *Attorney, Agent, or Firm* — David Peterson

(57) ABSTRACT

In one aspect, a bracket for evacuating a storage bag having a one-way valve element is provided that has parallel first and second flat panels that delineate a gap. A bag can be placed into the gap such that the valve element on the bag aligns with an aperture disposed through the first panel. To evacuate the bag, a nozzle of an evacuation device can be inserted through the aperture and pressed against the bag sidewall about the valve element. When the evacuation device is activated, the sidewall of the bag is pulled against the rim of the nozzle and air is drawn through the valve element. In another embodiment, the nozzle can be pressed against the first panel around the aperture. In another aspect, the bracket can be included as part of a handheld evacuation device.

6 Claims, 10 Drawing Sheets

U.S. PATENT DOCUMENTS 5,540,557 A 7/1996 Carson
5,655,357 A 8/1997 Kristen
5,667,627 A 9/1997 Plangetis
5,735,395 A * 4/1998 Lo ..... 206/278
5,765,608 A 6/1998 Kristen
5,784,862 A 7/1998 Germano
5,873,217 A 2/1999 Smith
6,058,998 A 5/2000 Kristen
6,256,968 B1 * 7/2001 Kristen ..... 53/512
6,357,915 B2 * 3/2002 Anderson ..... 206/524.8
6,520,071 B1 2/2003 Lanza
6,604,634 B2 * 8/2003 Su ..... 206/524.8
6,626,092 B2 9/2003 Tarlow
6,634,384 B2 * 10/2003 Skeens et al. ..... 206/524.8
6,883,665 B1 * 4/2005 Ahn ..... 206/524.8
6,964,519 B2 * 11/2005 ErkenBrack ..... 383/64
6,971,417 B2 12/2005 Deni
7,021,034 B2 4/2006 Higer et al.
7,076,929 B2 7/2006 Patterson et al.
7,086,211 B2 8/2006 Bassett et al.
7,350,541 B2 * 4/2008 Kobetsky ..... 206/524.8
7,510,326 B2 * 3/2009 Chen ..... 206/524.8
7,513,481 B2 * 4/2009 Su ..... 206/524.8
7,565,977 B2 * 7/2009 Frenkil ..... 206/524.8
7,578,320 B2 * 8/2009 Borchardt ..... 383/103
7,596,930 B2 * 10/2009 Borchardt ..... 53/434
7,597,479 B2 * 10/2009 Zimmerman et al. ..... 206/524.8
7,614,430 B2 * 11/2009 Bergman et al. ..... 206/524.8
7,805,913 B2 * 10/2010 Alipour et al. ..... 53/512
7,874,731 B2 * 1/2011 Turvey et al. ..... 383/103
7,937,914 B2 * 5/2011 Savicki et al. ..... 53/510
8,061,899 B2 * 11/2011 Zimmerman et al. ..... 383/100
2003/0183331 A1 10/2003 Ciambrone et al.
2005/0207679 A1 * 9/2005 Armstrong ..... 383/64
2008/0028730 A1 * 2/2008 Savicki et al. ..... 53/434
2009/0007803 A1 * 1/2009 Bergman et al. ..... 99/472
2009/0173038 A1 * 7/2009 Savicki et al. ..... 53/85
2009/0229225 A1 * 9/2009 Borchardt et al. ..... 53/434
2010/0180548 A1 * 7/2010 Binger ..... 53/434

* cited by examiner

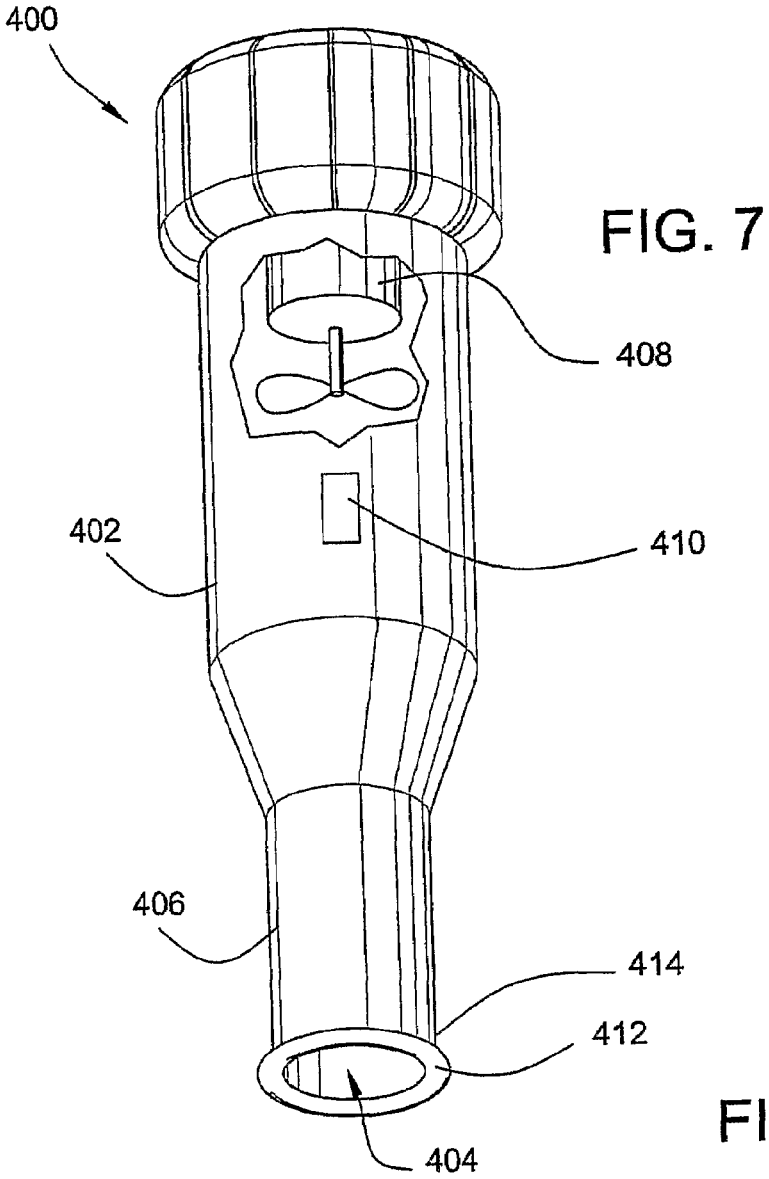
FIG. 7
FIG. 8
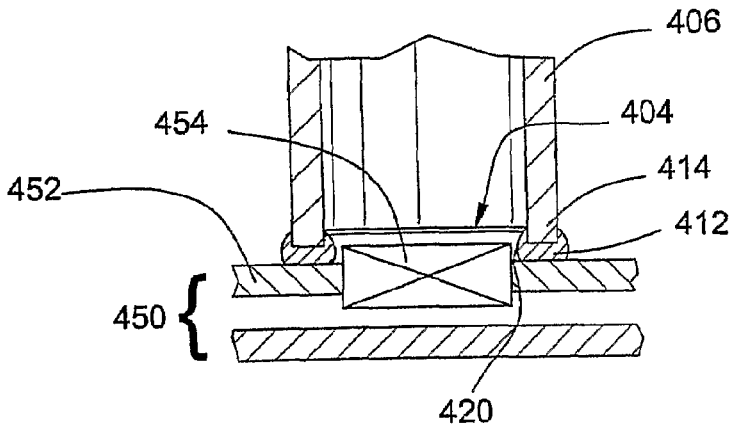

FIG. 11
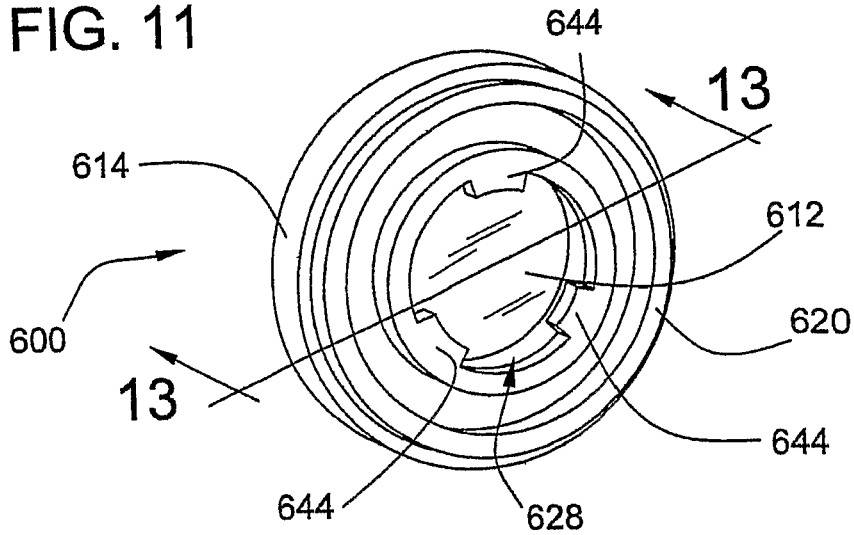
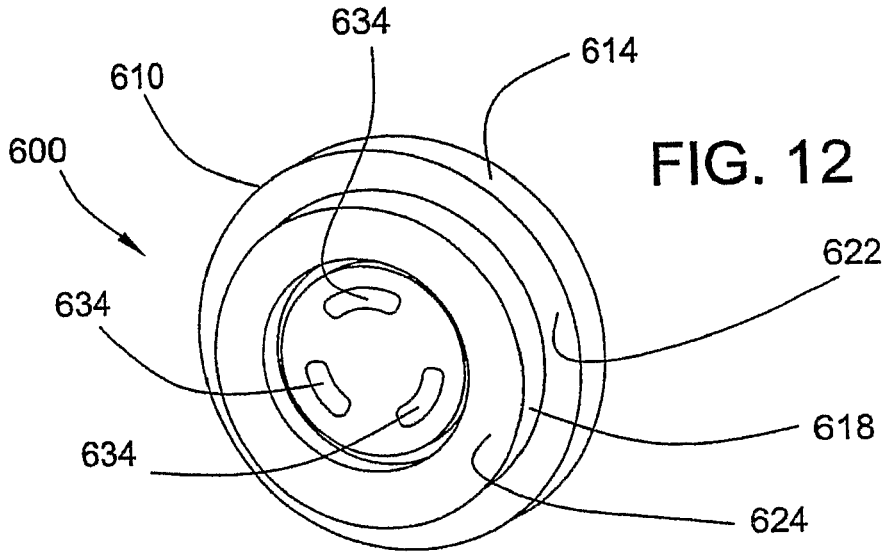
FIG. 12
FIG. 13
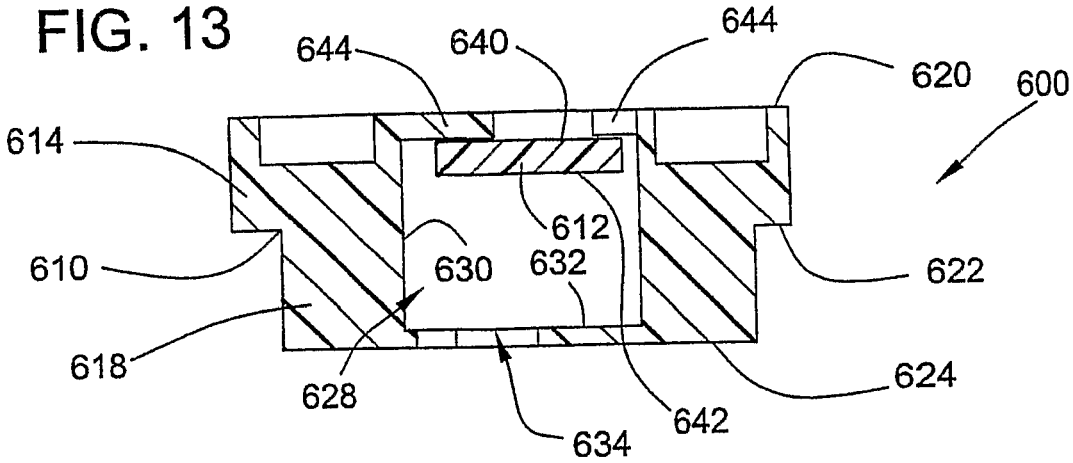

DEVICE AND METHOD FOR EVACUATING A STORAGE BAG

RELATED APPLICATIONS

This application is a continuation of PCT/US2006/019818, filed May 22, 2006, which claims benefit of U.S. Provisional Application No. 60/685,462, filed May 27, 2005.

FIELD OF THE INVENTION

This invention pertains generally to storage containers and, more particularly, to flexible, thermoplastic storage bags designed to be sealed and evacuated. The invention finds particular applicability in the field of food storage.

BACKGROUND OF THE INVENTION

Storage bags are commonly used for a variety of purposes such as storing food items. Such storage bags are typically made from a flexible, thermoplastic web material that is configured to provide an interior volume into which food items can be inserted. To preserve the inserted food, the storage bag may also include a distinct closing mechanism, such as interlocking fastening strips, for sealing closed an opening through which the interior volume is accessible.

One problem that occurs with the aforementioned storage bags is that latent air may remain trapped within the interior volume after sealing closed the opening. The trapped air may cause spoiling or dehydration of the food items. To remove the trapped air, it is known to provide a one-way valve element or other evacuation device communicating with the interior volume. The one-way valve element allows for the evacuation of trapped air while preventing the ingress of air from the surrounding volume into the interior volume. One known method of evacuating air through the valve element is to lay the storage bag on a horizontal surface and place the nozzle of an evacuation device against the bag so as to surround the valve element. When activated, the evacuation device draws air from the interior volume through the valve element.

The flexible material of the sidewall presents certain problems when evacuating storage bags in the foregoing manner. One problem that may arise is that the flexible sidewall may distort and displace under applied pressure from the evacuation device nozzle which may make the formation of a vacuum tight seal between the nozzle and the storage bag difficult and thereby inhibits evacuation. Also due in part to the flexibility of the sidewall material, the storage bag is often laid horizontally on a surface such as a table top for support during evacuation. When laid horizontally, the contents of the bag may shift towards the valve element where they can be drawn through the valve element and into the evacuation device.

BRIEF SUMMARY OF THE INVENTION

The invention provides a device and method to simplify and improve upon the evacuation of storage bags which utilize one-way valve elements. In one embodiment, the invention provides a comparatively rigid bracket adapted to support the flexible storage bag during evacuation. The bracket has two generally parallel, spaced-apart panels that provide a gap therebetween into which the flexible storage bag can be inserted. An aperture is disposed through one of the panels to permit access to the one-way valve element. To evacuate the bag, a nozzle of an evacuation device is inserted through the aperture and pressed adjacent the bag sidewall about the valve element. Because the aperture helps align the nozzle with the valve element, an improved seal is realized. Additionally, the first and second panels of the bracket may provide a clamping effect that helps prevent the storage bag from being drawn into the nozzle during evacuation. Another advantage is that the bracket allows the storage bag to be held vertically so that the contents fall under gravity to the bottom of the bag and away from the valve element.

In another embodiment, the nozzle of the evacuation device is pressed adjacent to the first panel about the aperture. Because the nozzle is interfaced against the comparatively rigid bracket rather than the flexible storage bag, an improved seal is realized. Additionally, the bracket and aperture may also help ensure that the nozzle and valve element align correctly.

In another embodiment, the invention provides a device for evacuating a storage bag which has a one-way valve element. The evacuation device may also include a housing that encloses an electrically powered airflow generating unit. The airflow generating unit communicates with an inlet opening disposed into the housing that is adapted to be placed about the one-way valve element attached to a storage bag. To improve the airtight seal that must be established between the evacuation device and the storage bag during evacuation, the evacuation device includes a gasket attached about the rim of the inlet opening. In another aspect, the evacuation device can include a bracket having parallel, spaced-apart first and second panels that provide a gap therebetween. The flexible storage bag can be inserted into the gap and the one-way valve element aligned with the inlet opening in the aforementioned manner. One advantage of the evacuation device is the improved seal provided by the gasket and/or bracket.

BRIEF DESCRIPTION OF THE DRAWINGS

FIG. 7 is a perspective view of a hand-held evacuation device that includes a housing with an inlet opening and a gasket attached about the rim of the inlet opening.

FIG. 8 is a cross-sectional view showing the inlet opening and gasket of the evacuation device interfacing with a flexible storage bag having a one-way valve element.

FIG. 11 is a front perspective view of an embodiment of a one-way valve element for use with flexible bags of the invention.

FIG. 12 is a rear perspective view of the one-way valve element of FIG. 11.

FIG. 13 is a cross-sectional view through the one-way valve element, as taken along line 13-13 of FIG. 11.

DETAILED DESCRIPTION OF THE INVENTION

Figure 1:
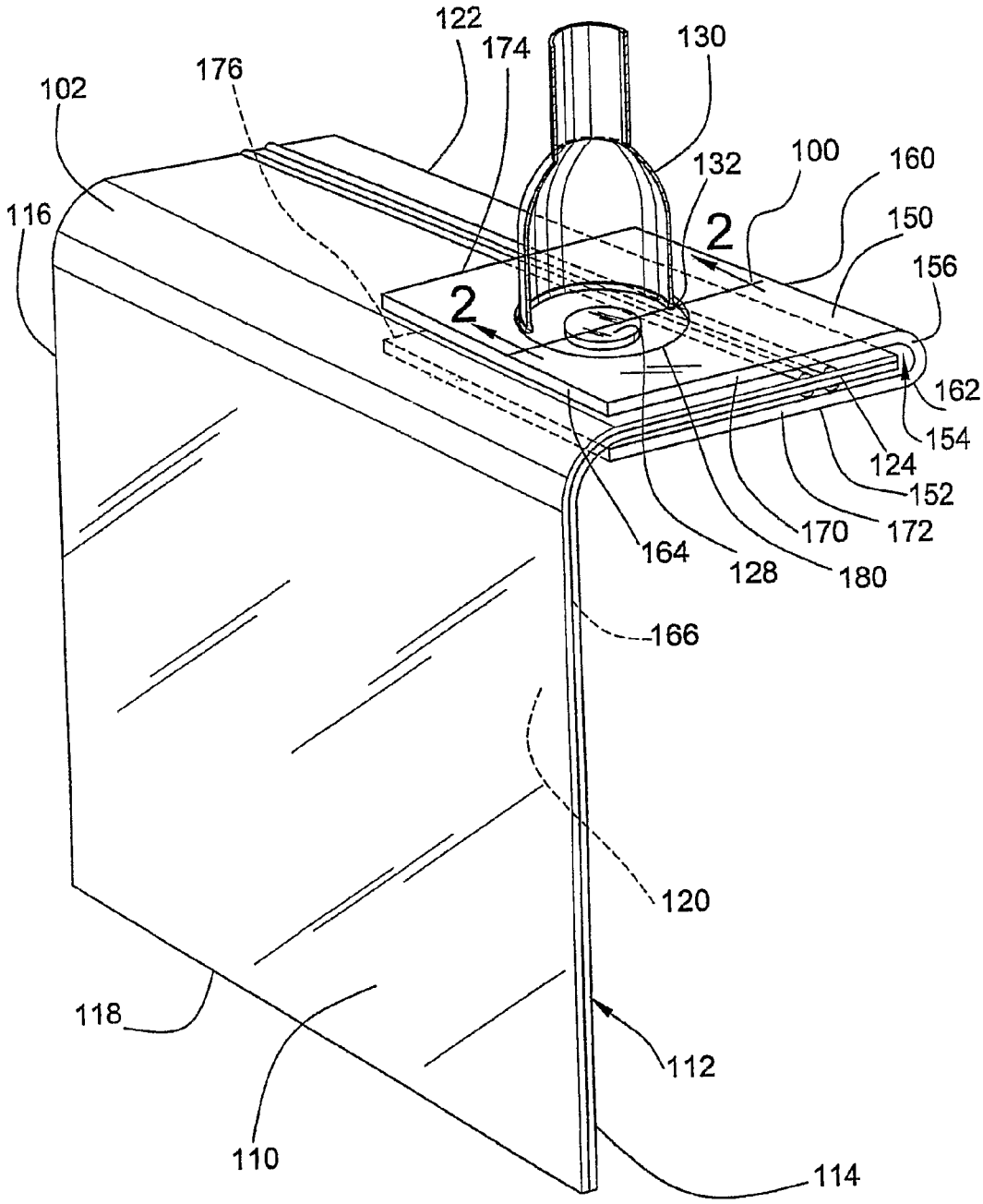
FIG. 1 is a perspective view of a support bracket receiving a flexible storage bag that has a one-way valve element, and a nozzle of a vacuum device, shown in breakaway, inserted through an aperture in the bracket to interface with the storage bag.

Now referring to the drawings, wherein like reference numbers refer to like elements, there is illustrated in FIG. 1 a support bracket 100 designed in accordance with the teachings of the present invention that is placed about a flexible storage bag 102. Storage bags 102 of the type intended for use with the inventive support bracket 100 are typically made from first and second sidewalls 110, 112 of flexible thermoplastic web material that are joined together along first and second side edges 114, 116 and a closed bottom edge 118 to provide an interior volume 120. To access the interior volume 120, an opening 122 is provided by leaving the top edges of the first and second sidewalls 110, 112 unconnected. To temporarily seal the opening 122 when desired, the storage bag 102 includes interlocking fastener strips 124.

As will be appreciated, once the opening 122 is sealed closed, latent air may remain trapped in the interior volume 120 of the storage bag 102. The latent air can cause food items stored in the internal volume to spoil and adds undesirable bulk to the bag. To remove the trapped air, the storage bag 102 may be supplied with a one-way valve element 128 attached to the first flexible sidewall 110 that communicates with the interior volume 120. Air can be exhausted from the interior volume by, for example, placing the nozzle 130 of an evacuation device about the one-way valve element 128 and activating the device to draw air through the valve element.

Figure 3:
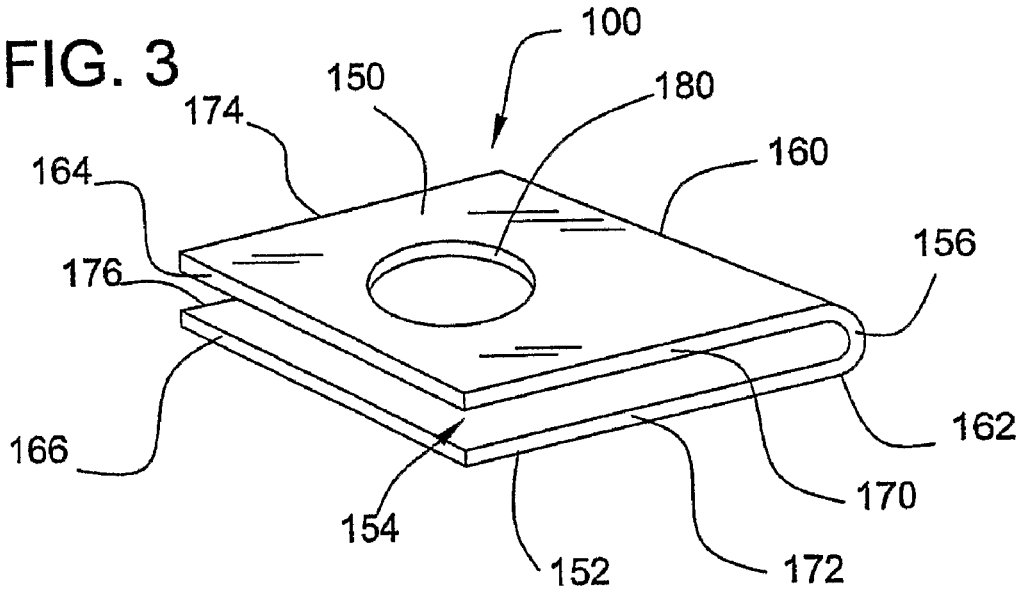
FIG. 3 is a top perspective view of the bracket having first and second panels and showing an aperture disposed in a first panel.
Figure 4:
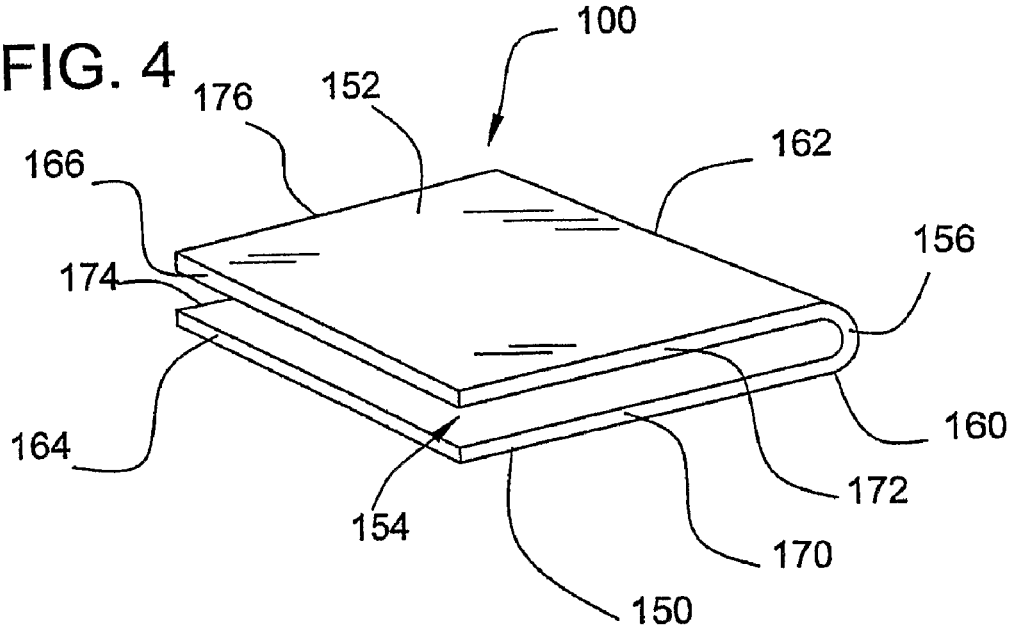
FIG. 4 is a bottom perspective view of the bracket.

To facilitate evacuation of air from the storage bag 102, the bag can be inserted into the inventive support bracket 100. Referring to FIGS. 1, 3, and 4, the bracket 100 includes a first panel 150 and a generally identical second panel 152. The first and second panels 150, 152 are flat, planar structures and, though they can have any suitable shape, in the illustrated embodiment, the panels are rectangular each with a first longer edge 160, 162 and parallel second longer edge 164, 166 and each with a first shorter edge 170, 172 and a parallel second shorter edge 174, 176. The panels 150, 152 are arranged parallel to and spaced apart from each other to provide a gap 154 for receiving the flexible storage bag 102. The interior and exterior surfaces of the panels 150, 152 can have a smooth finish. To connect the spaced-apart panels 150, 152 together, a U-shaped portion 156 extends along the corresponding first longer edges 160, 162. The bracket 100 can be made from any suitable material including, for example a comparably rigid thermoplastic.

Figure 2:
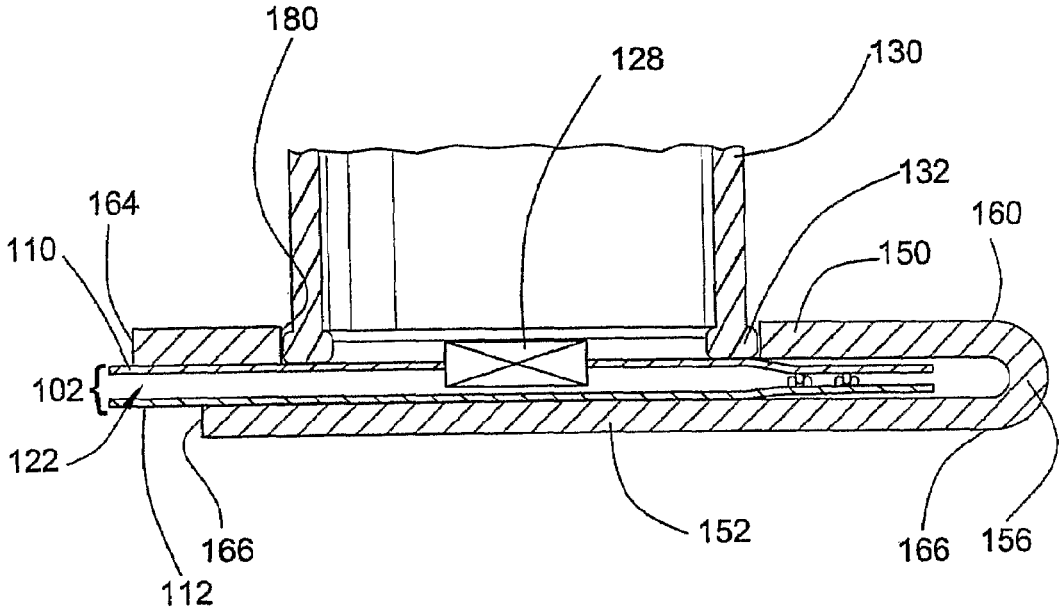
FIG. 2 is a cross-sectional view of the bracket, flexible storage bag, and nozzle taken along line 2-2 of FIG. 1.

To provide access to the one-way valve element 128 when the storage bag 102 has been inserted between the first and second panels 150, 152, an aperture 180 is disposed through the first panel 150. The aperture 180 can have any suitable shape including, as illustrated, circular. Referring to FIGS. 1 and 2, the aperture 180 can be placed a predetermined distance from the first longer edges 160, 162 that corresponds to the distance with which the valve element 128 is spaced from the opened top edge 122 of the storage bag 102. Furthermore, the aperture 180 can be spaced the same distance from the first shorter side edges 170, 172 as the valve element 128 is spaced from the first side edge 114 of the bag 100. Accordingly, when the storage bag 100 is inserted between the first and second panels 150, 152 such that the opened top edge 122 abuts against the U-shaped portion 156 and the first side edge 112 lines up with the first shorter edges 170, 172, the valve element 128 aligns with the aperture 162.

To evacuate the storage bag 102, the nozzle 130 is inserted through the aperture 180 in the first panel 150 and pressed adjacent the first sidewall 110 of the storage bag 102. Where the valve element 128 has been properly aligned with the aperture 180, the nozzle 130 will extend about the valve element. To enable the nozzle 130 to fit through the circular aperture 130 and extend about the valve element 128, in the illustrated embodiment, the nozzle 130 may also be circular and have a diameter less than that of the aperture. In this embodiment, the nozzle 130 has a diameter which is greater than that of the valve element. In other embodiments, the nozzle may contact the valve element and may be approximately the same size as the valve element when inserted through the aperture. When the vacuum device attached to the nozzle 130 is activated, the generated suction force will draw the portion of the first sidewall 110 exposed through the aperture 180 adjacent to the rim of the nozzle, thereby providing an air tight sealing interface between the nozzle and valve element 128. Because the rest of the storage bag 102 is constrained within the bracket 100, further suction draws latent air from the interior volume 120 through the one-way valve element 128.

To further improve the sealing interface between the nozzle 130 and the bag sidewall 110, the nozzle can include an annular gasket 132 attached about the rim. Additionally, the aperture 180 helps align the nozzle 130 with the valve element 128 to facilitate evacuation of the storage bag 100. Furthermore, because the storage bag 102 is held between the first and second panels 150, 152 and only exposed to the evacuation device via the aperture 180, the bracket 100 restrains the bag from being drawn into the nozzle during evacuation. As is apparent from FIG. 1, the bracket 100 also allows the bag 102 to be held vertically during evacuation with the top portion and valve element 128 folded to the side. Hence, the contents of the bag 100 will fall to the bottom edge 118 due to gravity and are less likely to be drawn into the valve element 128 and nozzle during evacuation.

Figure 5:
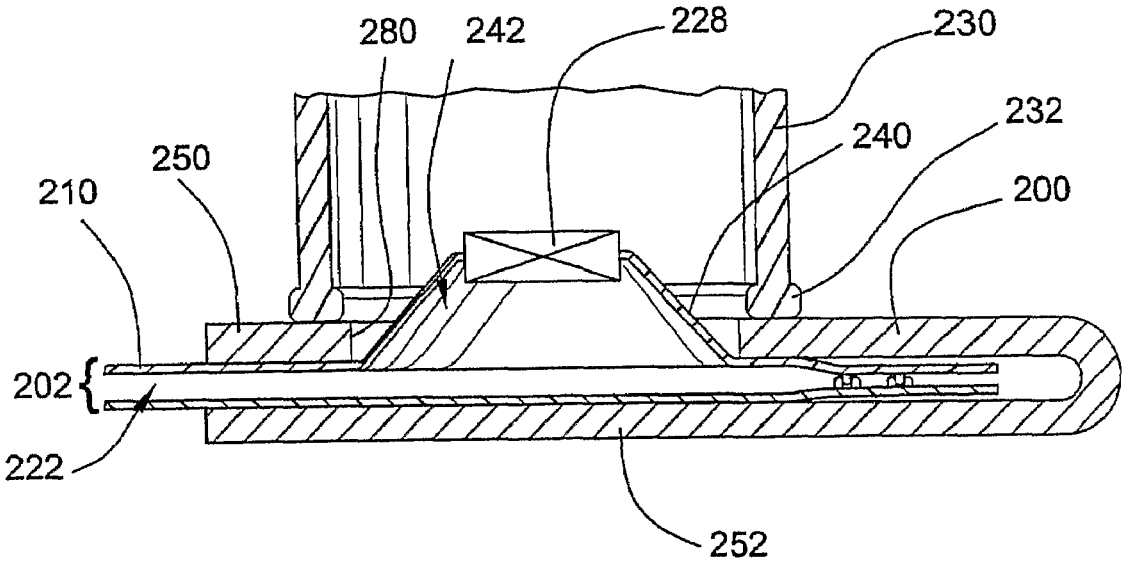
FIG. 5 is a cross-sectional view of a support bracket, a flexible storage bag, and a nozzle of an evacuation device, similar to FIG. 2, wherein the nozzle interfaces directly with the bracket and the flexible storage bag includes an expandable separator to which a one-way valve element is attached.

Illustrated in FIG. 5 is another manner of using a bracket 200 of the foregoing type to evacuate a storage bag 202. Instead of being inserted through the aperture as described above, the nozzle 230 connected to the evacuation device is pressed against the first panel 250 about the aperture 280. To fit around the circular aperture 280, in the illustrated embodiment, the nozzle 230 should also be circular and have a diameter larger than that of the aperture. Because the bracket 200 is rigid and the exterior surface of the first panel 250 is smooth, the nozzle 230 can make an airtight sealing interface about the aperture 280 above the valve element 228. The nozzle 230 can also include an annular gasket 232 attached about the rim to further improve the sealing interface between the nozzle and the bracket 200. Once the evacuation device is activated, as will be appreciated from FIG. 5, the suction in the nozzle 230 draws the first sidewall 210 adjacent the interior surface of the first panel 250 thereby blocking any flow of environmental air into the nozzle. Further suction draws latent air from the interior volume 222 through the valve element 228 to evacuate the storage bag 202. Hence, the bracket 200 helps support the flexible storage bag 202 during evacuation and provides a rigid support surface against which the nozzle 230 can be pressed.

In FIG. 5, the bracket 200 is illustrated in use with a storage bag 202 having a fluid separator 204 such as those described in U.S. patent application Ser. No. 11/039,735 which is incorporated by reference in its entirety. Storage bags 202 described in these applications have a fluid separator 240 formed in or attached to the first sidewall 210 that can expand under the influence of a vacuum source to provide a chamber 242 spacing the valve element 228 away from the second sidewall 212. The chamber 242 provided by the separator 240 functions to separate out fluids and juices entrained in the exhausting air. In the illustrated embodiment, so that the aperture 280 allows and assists the separator 240 in expanding into its expanded shape, the aperture can correspond in size and shape to the separator. Hence, the separator 240 can expand through and be outlined by the aperture 280.

Figure 6:
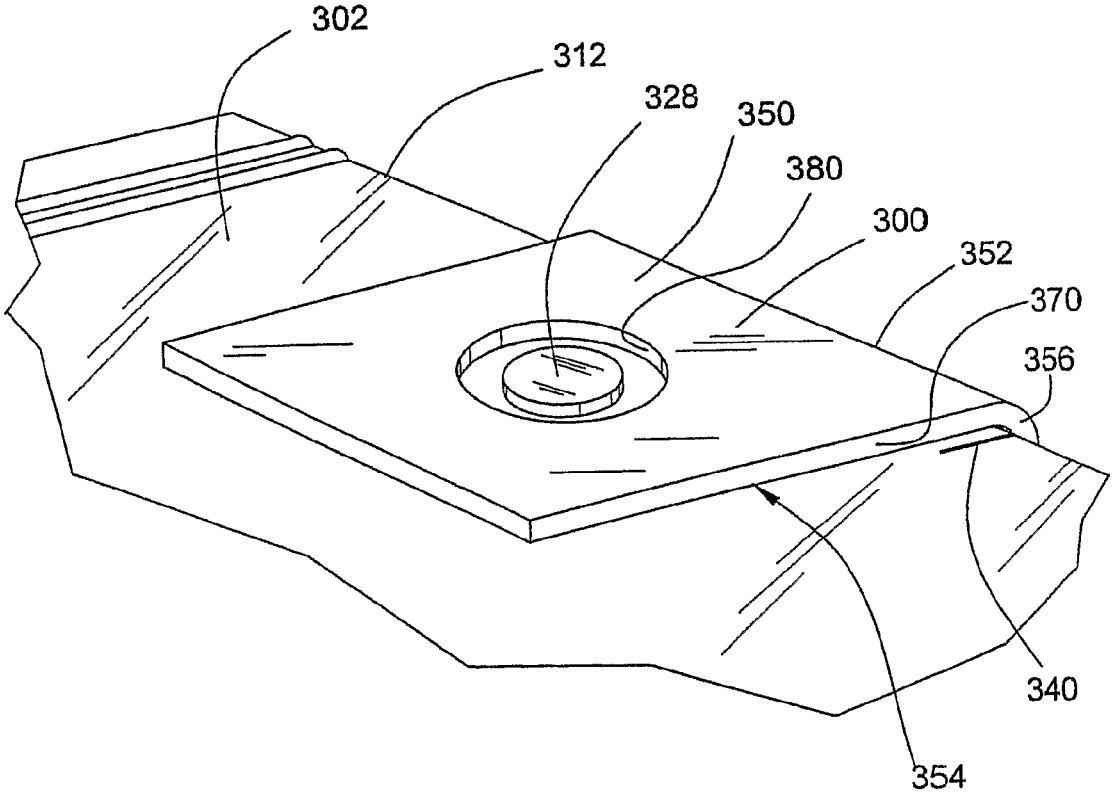
FIG. 6 is a perspective view of the support bracket receiving a flexible storage bag that has a one-way valve element and indicia for aligning the support bracket.

Illustrated in FIG. 6 is bracket 300 of the above-described design receiving a storage bag 302 having a one-way valve element 328. To facilitate aligning the valve element 328 with an aperture 380 disposed through the first panel 350 of the bracket 300, the distance the valve element is spaced-apart from an edge 312 of the storage bag 302 dimensionally corresponds with the distance that the aperture is spaced-apart from the U-shaped portion 356. Additionally, the storage bag 302 includes indicia 340 printed or otherwise marked along the edge 312. Hence, when the storage bag 302 is inserted into the gap 354 such that the edge 312 abuts the U-shaped portion 356 and a first shorter edge 370 of the first panel 350 lines up with the indicia 340, the valve element 328 aligns with and is exposed at aperture 380.

Referring to FIG. 7, there is illustrated an embodiment of a handheld evacuation device 400 for evacuating a storage bag. The evacuation device 400 includes an elongated housing 402 that can be made from rigid thermoplastic material and that has an air inlet opening 404 at one end of a nozzle portion 406. The nozzle portion 406 is generally cylindrical and situated in-line with the rest of the housing 402, though in other embodiments the nozzle portion and housing could have other shapes and configurations. The housing 402 also encloses an airflow generating unit 408. The illustrated airflow generating unit 408 is electrically powered and can be selectively activated by a switch 410 exposed on the exterior of the housing 406. It will be appreciated that in other embodiments the airflow generating device 408 can take other forms such as, for instance, a hand operated pump. To evacuate a storage bag 450 using the evacuation device 400, referring to FIG. 8, the nozzle portion 406 can be pressed directly against the sidewall 452 of the bag 450 so that the inlet opening 404 surrounds a one-way valve element 454 attached to the sidewall. Of course, it will be readily appreciated that in other embodiments, evacuation device 400 can be used with a support bracket such as the type described above.

To enhance the sealing interface between the storage bag 450 and the evacuation device 400, the evacuation device can include a gasket 412 attached about the rim 414 of the inlet opening 404. In the illustrated embodiment, where the nozzle 406 and inlet opening 404 are circular, the gasket 412 will have an annular shape. The gasket 412 can be made from any suitable material such as, for example, resilient foam or an elastomeric material. Moreover, as illustrated in FIG. 6, the gasket can have a circular cross-section and can be fashioned as an o-ring attached to the rim 414. When the gasket 412 is pressed against the sidewall 452 of the bag 450, the gasket deforms to provide a leak-free interface. It will be appreciated that, in the embodiments in which the gasket 412 is resilient and has a circular cross-section, pressing the evacuation device 400 further against the sidewall 452 causes further deformation of the gasket. Thus, a larger surface area 420 of the gasket 412 contacts the sidewall 452, thereby improving the sealing effect. Furthermore, the gasket 412 can be impregnated with oil or other material to improve its sealing effect against the sidewall 452.

The bag 450 and the evacuation device 400 of FIGS. 7 and 8 can be provided and distributed together as a system so that an end user can store and preserve food items in the foregoing manner. In addition, the brackets 100, 200 of FIGS. 1-4 may also be distributed with the bag, the evacuation device, or both.

Figure 9:
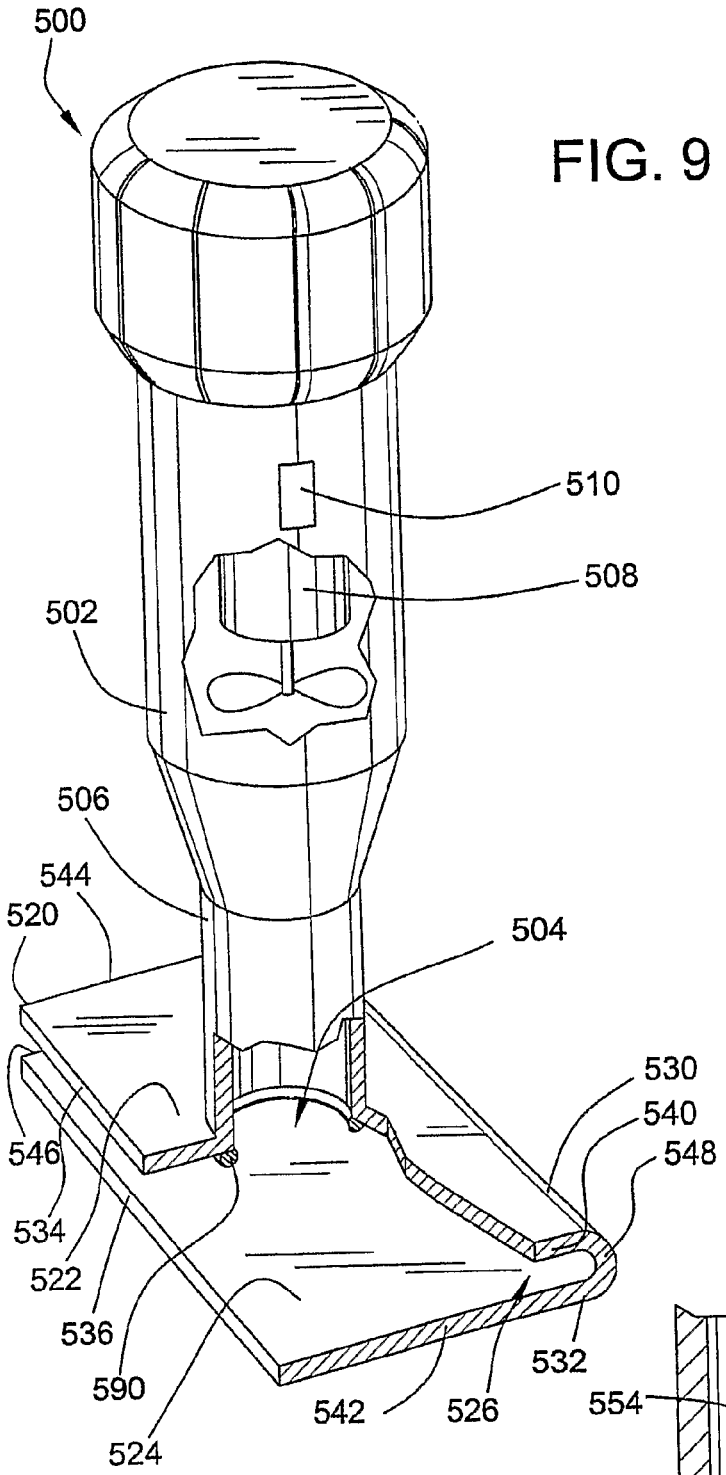
FIG. 9 is a perspective view of another embodiment of a hand-held evacuation device that includes a housing with an inlet opening and a support bracket joined about the inlet opening.

Illustrated in FIG. 9 is another embodiment of a handheld evacuation 500 device for removing latent air from a storage bag via a one-way valve element. The evacuation device 500 also has an elongated housing 502 that can be made from thermoplastic material. The housing 502 has an inlet opening 504 at one end of a nozzle portion 506. To actually enable evacuation, the housing 502 encloses an airflow generating unit 508 that communicates with the inlet opening 504. The airflow generating unit 508 is electrically operated and can be selectively activated by a switch 510 exposed on the exterior of the housing 502. It will be appreciated that in other embodiments the airflow generating device 508 can take other forms such as, for instance, a hand operated pump.

To facilitate evacuation of flexible storage bags, the evacuation device 500 also includes an integral bracket 520 proximate the inlet opening 504. As described above, the bracket 520 has parallel first and second panels 522, 524 that are spaced apart from each other to provide a gap 526. While the first and second panels 522, 524 can have any suitable shape, in the illustrated embodiment, the panels are rectangular, each having first longer edges 530, 532 and parallel second longer edges 534, 536 and each having a first shorter edges 540, 542 and a parallel second shorter edges 544, 546. To connect the panels together, a U-shaped portion 548 extends along and is joined to the first longer edges 530, 532. As will be appreciated, the 180 degree U-shaped portion 548 holds the first and second panels 522, 524 parallel and defines the size of the gap 526.

Figure 10:
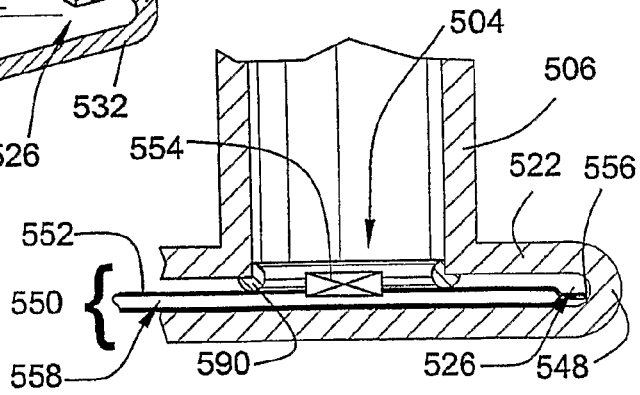
FIG. 10 is a cross-sectional view showing the inlet opening and support bracket interfacing with the flexible storage bag having a one-way valve element.

To join the bracket 520 to the rest of the evacuation device 500, the first panel 522 can be integrally formed with and is orthogonal to the nozzle portion 506. As illustrated in FIG. 10, the inlet opening 504 is disposed through the first panel 522 to interface with a one-way valve element 554 attached to a storage bag 550 that has been inserted into the gap 526. Preferably, the valve element 554 will be attached at a predetermined distance from an edge 556 of the storage bag 550 which corresponds to the distance between the U-shaped portion 548 and the inlet opening 504. Hence, when a storage bag 500 is inserted into the gap 526 such that the edge 556 abuts against the U-shaped portion 548, the valve element 554 aligns with the inlet opening 504.

Referring to FIG. 9, to enhance the leak tight interface between the storage bag 550 and the evacuation device 500, a gasket 590 can be attached about the rim of the inlet opening 504. In the illustrated embodiment where the inlet opening 504 is circular, the gasket 590 has an annular shape. The gasket 590 can be made of any suitable material including, for example, foam or an elastomeric material. The gasket 590 is disposed along the rim of the inlet opening 504 such that a portion protrudes into gap 526 between the first and second panels 522, 524. Referring to FIG. 10, when a bag 550 is inserted into the gap 526 and the evacuation device is activated, the sidewall 552 of the bag is forced against the gasket 590 thereby blocking any flow of environmental air into the nozzle 506. Further evacuation draws latent air from the interior volume 558 through the valve element 554 to evacuate the storage bag 550.

Referring to FIGS. 11, 12, and 13, the one-way valve element 600 for use with a storage bag of the foregoing type can include a rigid valve body 610 that cooperates with a movable disk 612 to open and close the valve element. The valve body 610 includes a circular flange portion 614 extending between parallel first and second flange faces 620, 622. Concentric to the flange portion 614 and projecting from the second flange face 622 is a circular boss portion 618 which terminates in a planar boss face 624 that is parallel to the first and second flange faces. The circular boss portion 618 is smaller in diameter than the flange portion 614 so that the outermost annular rim of the second flange face 622 remains exposed. The valve body 610 can be made from any suitable material such as a moldable thermoplastic material like nylon, HDPE, high impact polystyrene (HIPS), polycarbonates (PC), and the like.

Disposed concentrically into the valve body 610 is a counter-bore 628. The counter-bore 628 extends from the first flange face 620 part way towards the boss face 624. The counter-bore 628 defines a cylindrical bore wall 630. Because it extends only part way toward the boss face 624, the counter-bore 628 forms within the valve body 610 a preferably planar valve seat 632. To establish fluid communication across the valve body 610, there is disposed through the valve seat 632 at least one aperture 634. In fact, in the illustrated embodiment, a plurality of apertures 634 are arranged concentrically and spaced inwardly from the cylindrical bore wall 630.

To cooperatively accommodate the movable disk 612, the disk is inserted into the counter-bore 628. Accordingly, the disk 612 is preferably smaller in diameter than the counter-bore 628 and has a thickness as measured between a first disk face 640 and a second disk face 642 that is substantially less than the length of the counter-bore 628 between the first flange face 620 and the valve seat 632. To retain the disk 612 within the counter-bore 630, there is formed proximate to the first flange face 620 a plurality of radially inward extending fingers 644. The disk 612 can be made from any suitable material such, as for example, a resilient elastomer.

Referring to FIG. 13, when the disk 612 within the counter-bore 630 is moved adjacent to the fingers 644, the valve element 600 is in its open configuration allowing air to communicate between the first flange face 620 and the boss face 624. However, when the disk 612 is adjacent the valve seat 632 thereby covering the apertures 634, the valve element 600 is in its closed configuration. To assist in sealing the disk 612 over the apertures 634, a sealing liquid can be applied to the valve seat 632. Furthermore, a foam or other resilient member may be placed in the counter-bore 628 to provide a tight fit of the disk 612 and the valve seat 632 in the closed position.

To attach the valve element 600 to the first sidewall, referring to FIG. 12, an adhesive can be applied to the exposed annular rim portion of the second flange face 622. The valve element 600 can then be placed adjacent the exterior surface of the first sidewall with the boss portion 618 being received through the hole disposed into the sidewall and thereby pass into the internal volume. Of course, in other embodiments, adhesive can be placed on other portions of the valve element, such as the first flange face, prior to attachment to the sidewall.

In other embodiments, the one-way valve element can have a different construction. For example, the one-way valve element can be constructed from flexible film materials similar to those disclosed in U.S. Pat. No. 2,927,722, U.S. Pat. No. 2,946,502, and U.S. Pat. No. 2,821,338, all incorporated by reference in their entirety.

Figure 14:
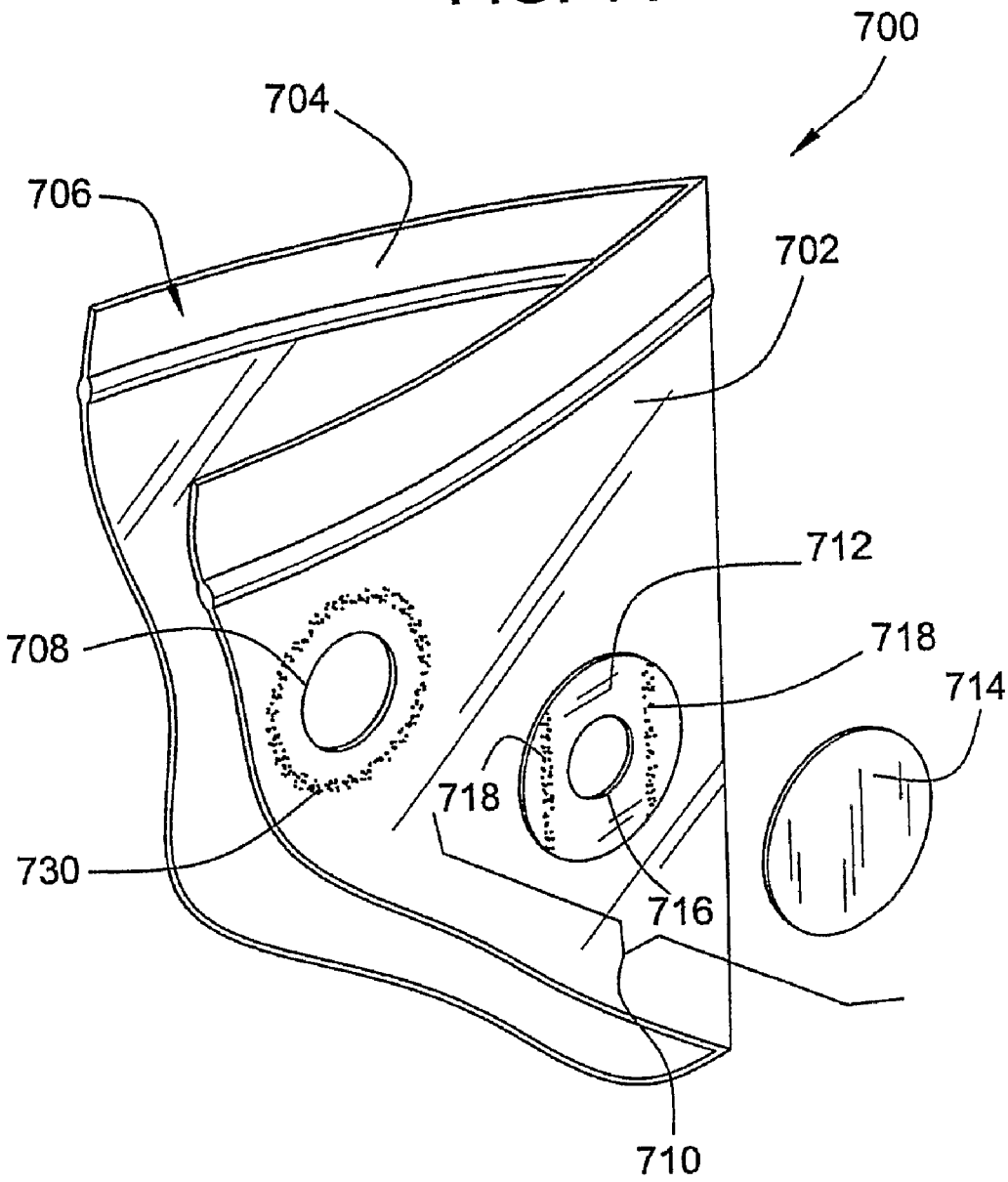
FIG. 14 is an exploded view of another embodiment of the one-way valve element for attachment to the flexible bag.

As illustrated in FIG. 14, such a flexible one-way valve element 710 made in accordance with this style can include a flexible, circular base layer 712 that cooperates with a correspondingly circular shaped, resilient top layer 714 to open and close the valve element. The top and bottom layers can be made from any suitable material such as, for example, a flexible thermoplastic film. Disposed through the center of the base layer 712 is an aperture 716, thus providing the base layer with an annular shape. The top layer 714 is placed over and adhered to the base layer 712 by two parallel strips of adhesive 718 that extend along either side of the aperture 716, thereby covering the aperture with the top layer and forming a channel. The base layer 712 is then adhered by a ring of adhesive 720 to the flexible bag 700 so as to cover the hole 708 disposed through the first sidewall 702.

As will be appreciated by those of skill in the art, when the sidewalls 702, 704 of the bag 700 are forcibly compressed together, air from the internal volume 706 will pass through the hole 708 and the aperture 716 thereby partially displacing the top layer 714 from the base layer 712. The air can then pass along the channel formed between the adhesive strips 718 and escape to the environment. When the force on the sidewalls 702, 704 is released, the resilient top layer 714 will return to its prior configuration covering and sealing the aperture 716. The valve element 710 may also contain a viscous material such as an oil, grease, or lubricant between the two layers in order to prevent air from reentering the bag. In an embodiment, base layer 712 may also be a rigid sheet material.

Figure 15:
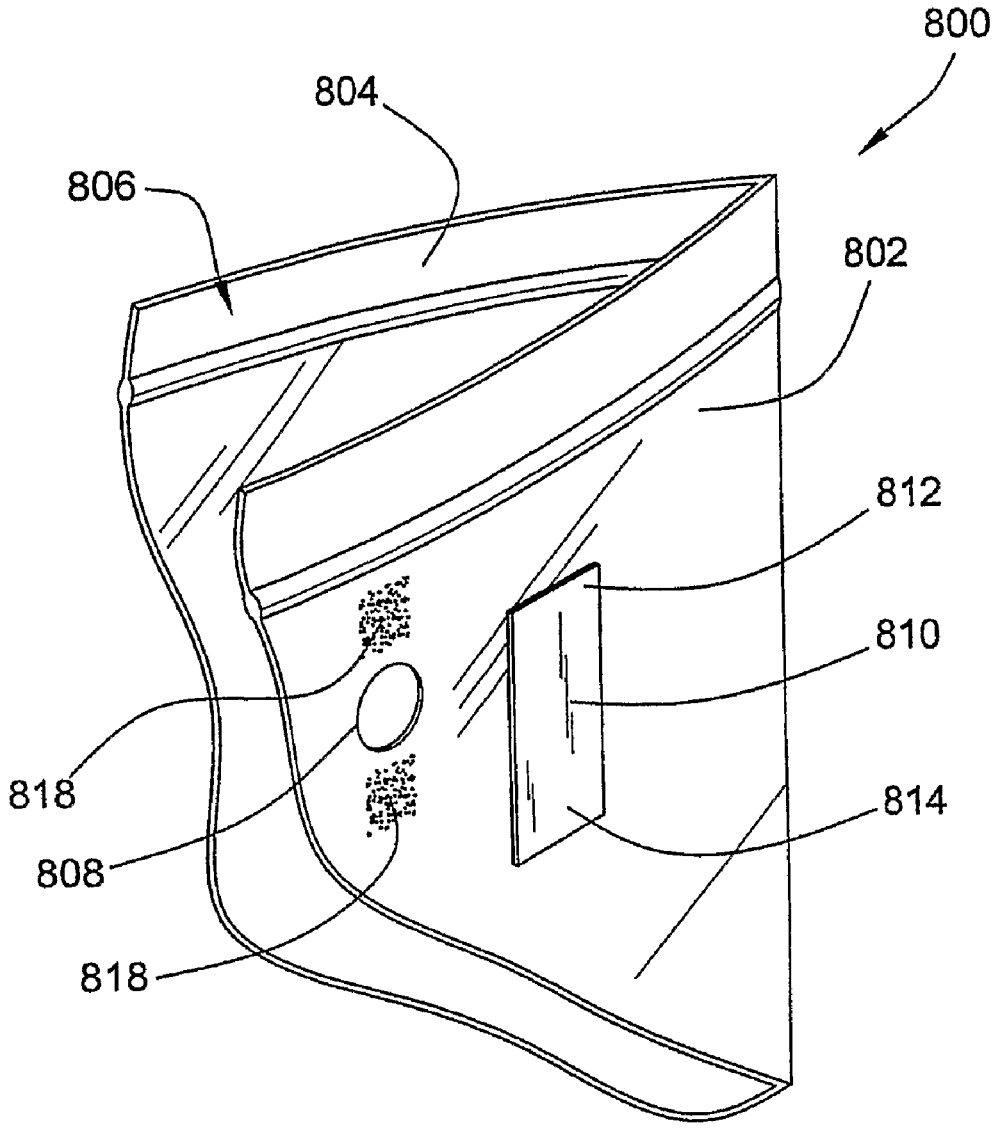
FIG. 15 is an exploded view of another embodiment of the one-way valve element for attachment to the flexible bag

Illustrated in FIG. 15 is another embodiment of the valve element 810 that can be attached to the flexible plastic bag 800. The valve element 810 is a rectangular piece of flexible thermoplastic film that includes a first end 812 and a second end 814. The valve element 810 is attached to the first sidewall 802 so as to cover and seal a hole 808 disposed through the first sidewall. The valve element 810 can be attached to the sidewall 802 by patches of adhesive 818 placed on either side of the hole 808 so as to correspond to the first and second ends 812, 814. When the sidewalls 802, 804 of the flexible bag 800 are collapsed together, air from the internal volume 806 displaces the flexible valve element 810 so as to unseal the hole 808. After evacuation of air from the internal volume 806, the valve element 810 will again cover and seal the hole 808.

As will be appreciated by those of skill in the art, other embodiments of one-way valve elements can be used with the flexible plastic bag such as, for example, an elastomer slit valve, duckbill valve or check valve.

Hence, the invention provides several devices and methods for improving the evacuation of a storage bag having a one-way valve element attached thereto.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of evacuating a storage bag, the storage bag including a flexible sidewall providing an interior volume, a sealable opening for accessing the interior volume, and a one-way valve element attached to the sidewall and communicating with the interior volume, the method comprising:

providing a integral support bracket comprising a first flat panel and a parallel second flat panel integrally connected to the first panel to provide a gap therebetween;

placing the storage bag between the first and second flat panels;

aligning the one-way valve element with an aperture disposed through the first panel;

pressing a nozzle of a vacuum device orthogonally against the first panel about the aperture; and evacuating the interior volume.

2. The method of claim 1, wherein the nozzle includes a gasket about the rim to provide a sealing interface with the bracket.

3. A method of evacuating a storage bag, the storage bag including a flexible sidewall defining an interior volume, a sealable opening for accessing the interior volume, and a one-way valve element attached to the sidewall and communicating with the interior volume, the method comprising:

providing an evacuation device for removing air from a storage bag, the evacuation device comprising a housing, an air flow generating unit enclosed in the housing, an inlet opening disposed into the housing, and a support bracket integral to the housing and including a first flat panel joined to the housing proximate the inlet opening and a parallel second flat panel connected to the first panel to provide a gap therebetween for receiving the storage bag;

placing the storage bag into the gap;

aligning the one-way valve element with the inlet opening; and evacuating the interior volume.

4. The method of claim 3, wherein the evacuation device further includes a gasket disposed about a rim of the inlet opening to provide a sealing interface with the storage bag.

5. A method of evacuating a storage bag, the storage bag including a flexible sidewall providing an interior volume, a sealable opening for accessing the interior volume, and a one-way valve element attached to the sidewall and communicating with the interior volume, the method comprising:

providing a rigid support bracket comprising a first flat, rigid panel and a parallel second flat, rigid panel integrally connected to the first panel to provide a gap therebetween;

placing the storage bag between the first and second flat panels;

aligning the one-way valve element with an aperture disposed through the first panel;

pressing a nozzle of a vacuum device through the aperture and against the one-way valve element; and evacuating the interior volume.

6. A method of evacuating a storage bag, the storage bag including a flexible sidewall providing an interior volume, a sealable opening for accessing the interior volume, and a one-way valve element attached to the sidewall and communicating with the interior volume, the method comprising:

providing an integral support bracket comprising a first flat, rigid panel and a parallel second flat, rigid panel integrally connected to the first panel by a rigid U-shaped portion to provide a gap between the first panel and the second panel;

placing the storage bag between the first and second flat panels;

aligning the one-way valve element with an aperture disposed through the first panel;

pressing a nozzle of a vacuum device through the aperture and against the one-way valve element; and evacuating the interior volume.

* * * * *